United States Patent [19]

Tsutsumi et al.

[11] Patent Number: 4,702,117

[45] Date of Patent: Oct. 27, 1987

[54] LOCK ACTUATOR FOR A PAIR OF LOCKS

[75] Inventors: Sunsaku Tsutsumi; Takurou Ozawa, both of Tokyo, Japan

[73] Assignee: Kokusan Kinzoku Kogyo Kabushiki Kaisha, Tokyo, Japan

[21] Appl. No.: 846,157

[22] Filed: Mar. 31, 1986

[51] Int. Cl.[4] ..... E05B 53/00

[52] U.S. Cl. ..... 74/89.17; 74/471 R; 74/501 R; 292/172; 292/225; 292/336.5; 254/230

[58] Field of Search ..... 74/89.17, 89.2, 471 R, 74/501 R, 501 A; 70/256, 257, 241; 292/201, 171, 172, 225, 226, 336.5, DIG. 42; 254/230, 241

[56] References Cited

U.S. PATENT DOCUMENTS

| | | | |
|---|---|---|---|
| 2,933,943 | 4/1960 | Buddo | 74/471 |
| 3,016,968 | 1/1962 | Lenz et al. | 70/256 |
| 3,675,371 | 7/1972 | Golde et al. | 74/89.2 |
| 4,290,634 | 9/1981 | Gelhard | 292/201 |
| 4,525,004 | 6/1985 | Tanaka | 70/256 |
| 4,526,057 | 7/1985 | Mochida et al. | 74/471 R |

FOREIGN PATENT DOCUMENTS

| | | | |
|---|---|---|---|
| 450261 | 10/1927 | Fed. Rep. of Germany | 74/501 A |
| 2557970 | 7/1977 | Fed. Rep. of Germany | 70/241 |
| 2039319 | 8/1980 | United Kingdom | 292/171 |
| 2134210 | 8/1984 | United Kingdom | 74/89.17 |

*Primary Examiner*—Cornelius J. Husar
*Assistant Examiner*—Eric K. Nicholson
*Attorney, Agent, or Firm*—Fleit, Jacobson, Cohn & Price

[57] ABSTRACT

A vehicle use-lock actuator is proposed comprising a stationary housing and a reversible drive motor for locking and unlocking successively two remotely positioned locks. In this actuator, the drive motor is mounted within the housing in a hidden position. There is a single control slide for keeping normally respective wire cables at their neutral position for keeping in turn the locks in their locked position. There is provided within the housing a three stage reduction and reversely accelerating gearing between the drive motor and the control slide. The first stage includes a crown gear, while the third stage includes rack teeth which is united rigidly with the control slide.

5 Claims, 4 Drawing Figures

LOCK ACTUATOR FOR A PAIR OF LOCKS

BACKGROUND OF THE INVENTION

1. Field of the Invention

The invention relates to improvements in and relating to lock actuators. More specifically, the invention relates to such an actuator which operates for unlocking and locking successively two different locks from a sole control origin.

Although not limitative, the invention can be most advantageously applied to the actuator adapted for unlocking and locking two different locks provided for a trunk lid and a gasoline tank lid on an automotive vehicle.

2. Description of the Prior Art

It is a conventional technique to provide respective actuators for a vehicle trunk lid lock and a gasoline tank or reservoir lid lock, wherein each of said actuators comprises an electric drive motor or actuating solenoid controllable with a switch mounted in close proximity of the vehicle driver's seat, and said motor or solenoid, when operated, acts to pull a wire cable leading to the related lid lock for unlocking the latter.

Thus, it will be seen that in such a conventional lock actuator, the motor- or solenoid-driven actuating unit is provided and arranged one by one for these lid locks, which arrangement represents, indeed, a grave drawback.

SUMMARY OF THE INVENTION

It is, therefore, an object of the present invention to provide a single and common lock actuator which can operate two different locks successively by manipulation of a single switching unit.

For attaining the above and further objects, the lock actuator according to this invention comprises a container housing; a drive motor of reversible type and mounted in the said container housing; a remote control switching unit for operation control of the said drive motor; an operation control slide mounted in the said container housing and translatable in a reciprocatable manner; a first operation-transmitting wire cable leading from said slide to one of said locks; a second operation-transmitting wire cable leading from said slide to the other of said locks, the inner, motion-receiving enlarged heads of both cable wires being arranged substantially opposite to each other; an at least two stage reduction and reversely accelerating gearing arranged between said drive motor and said operation control slide, the latter having three operating positions, one of which is one offset one for pullingly actuating the first wire cable; neutral, and an oppositely offset one for pullingly actuating the second wire cable.

The sole drive motor may preferably be an electric motor. However, when necessary, the motor may be of the hydraulic or pressure oil type; or pressure air driven type.

It should be noted that in these modified embodiments, the remote control switching unit may be a valve, of three way type, adapted for control off the flow of pressure fluid medium to said drive motor so as to bring the latter into its forward drive, neutral or zero drive and its rearward or opposite drive.

The first and second wire cables must be preferably of the self-return type. Each of them is fitted at its outer lock-operating end with a return spring or oil- or air-damper or the like automatic return drive means. When electric current or pressure fluid supply has been ceased, the return spring or the like will release its stored energy and the thus developed return movement will be transmitted reversedly through the cable to the slide which is caused thereby to return from its offset or lock-unlocking position back to its central or neutral position.

The aforementioned two locks may preferably be the vehicle truck lid lock and vehicle fuel reservoir cap lid lock. The operation control slide may preferably be fitted with a series of rack teeth, acting as the last stage member of the at least two stage reduction and reversely accelerating gearing. This gearing may be of rather flattened type of the inclusion of at least one crown gear.

When either one of the first and second wire cables is freed from its offset actuating or lock-unlocking position, motion will be transmitted reversely from the related automatic return actuating means, preferably a return spring, fitted at the outer end of the wire cable, through the latter to the slide, thence further through the gearing acting now as the speed accelerator, to the said drive motor, the rotor thereof being returned to its neutral position ready for receiving a next operative instruction from the sole and common switching unit.

A second object of the present invention is, therefore, to provide a lid lock actuator which has a rather compact and rather flattened design adapted for reducing the overall outline dimensions and production cost.

These and further objects, features and advantages of the invention will become more apparent when reading the following detailed description of a preferred embodiment of the invention, with reference to the accompanying drawings, in which:

BRIEF DESCRIPTION OF THE DRAWINGS

FIG. 3, (II), is a similar view to FIG. 3, (I), wherein however, the operation control slide is positioned for actuating the first wire cable relating to the first lid lock to be unlocked.

FIG. 3, (III), is again a similar view, wherein, however, the operation control slide is positioned for actuating the second wire cable relating to the second lid lock to be unlocked.

DETAILED DESCRIPTION OF A PREFERRED EMBODIMENT

Referring now to the accompanying drawings, a preferred embodiment of the invention will be illustrated hereinbelow.

Figure 1:
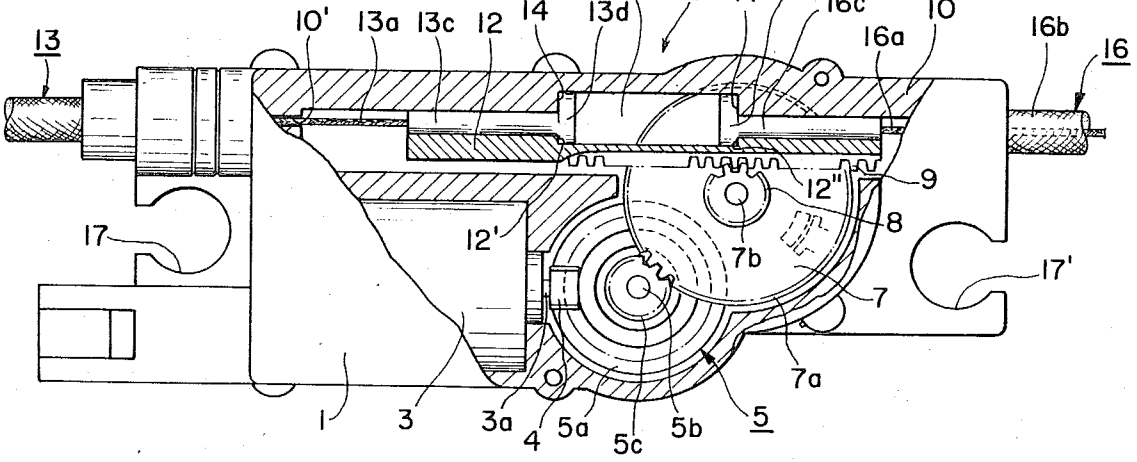
FIG. 1 is an elevational view of main part of the inventive lock actuator, partially sectioned and partially broken away, showing the neutrally positioned operation slide, corresponding to the locked positions of two different lid locks.
Figure 2:
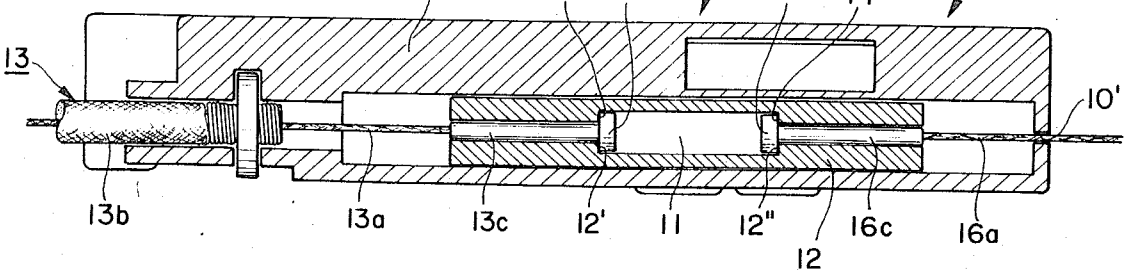
FIG. 2 is a sectional view of the same lock actuator, the section being taken along an imaginary plane of the operation slide and taken at right angles to the sectional plane adopted in FIG. 1.
Figure 4:
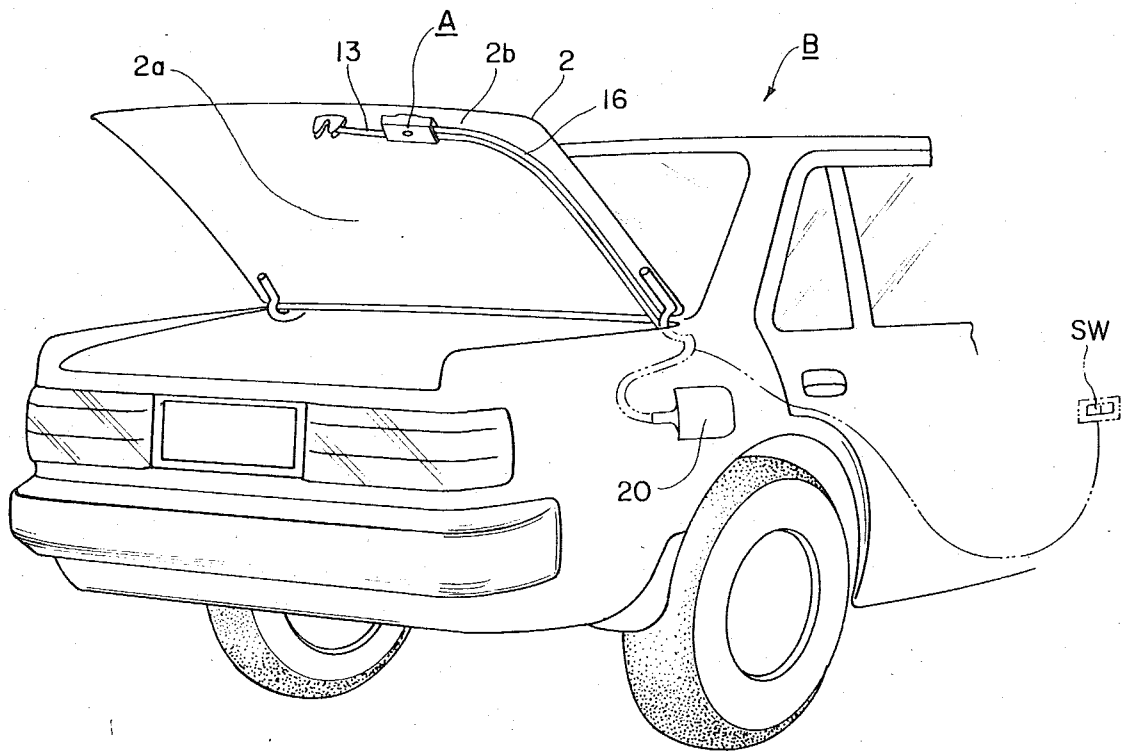
FIG. 4 is a perspective view of the rear part of a vehicle, mainly showing its opened trunk lid and the actuator "A" fitted on the rear surface thereof.

Throughout several drawings, more specifically FIGS. 1, 2 and 4, character "A" generally represents a motor-driven main drive unit or assemble, comprising a container housing 1.

In FIG. 1, an electric drive motor 3, of the reversible type, is mounted in the container housing 1. For simplicity of the drawing, the motor 3 is shown by its housing and its motor shaft 3*a* only, thus its conventional stator and rotor mounted within the motor housing being omitted. Naturally, the shaft 3*a* is mechanically and rigidly connected with the rotor.

Motor 3 is on/off operated by manipulation of a remote control swich SW, shown in FIG. 4. This switch is mounted at a proper position selected in close proximity of the driver's seat not shown, of an automotive vehicle B, shown in FIG. 4, for providing easy manipulation possibility for the vehicle driver from the vehicle interior, although such switching mounting mode is not shown specifically.

As may be well understood, the switch SW has three manipulation positions for forward drive, off service and reverse drive, preferably with use of a switching slide, although not shown.

A drive pinion 4 is rigidly mounted on the tip end of the motor shaft 3*a* and kept in meshing with crown gear teeth 5*a* on first composite gear 5 which comprises short shaft 5*b* and pinion 5*c* mechanically connected into one rigid part of the machine. As will be noted, pinion 4 and crown gear teeth 5*a* constitute a first reduction gearing stage.

Pinion teeth 5*c* are kept in meshing with spur gear teeth 7*a* of second comoposite gear 7 which comprises short shaft 7*b* and pinion 8 again mechanically connected into one rigid part of the machine similarly. The combination of pinion 5*c* and spur gear teeth 7*a* provides a second reduction gearing stage.

The pinion 8 is kept in meshing with rack teeth 9 formed on an operation control slide 12 which is capable of moving in opposite horizontal directions and within a hollow space 11 of container housing 1. The combination of pinion 8 with rack teeth 9 provides a third and final redution gearing stage.

On the upper surface of the slide 12, a pair of remote stop shoulders 12'; 12'' for detachably contacting with the enlarged inner ends 13*d;* 16*d* formed on positioner motion receiver pieces 13*c;* 16*c* of respective core wires 13*a;* 16*a* of first and second wire cables 13 and 16, respectively.

The first wire cable 13 is provided with a flexible sheath 13*b* through which the said first core wire 13*a* extends. In the similar way, the second wire 16 is provided with a flexible sheath 16*b* through which the said second core wire 16*a* extends.

The first wire cable 13 is arranged for unlocking the first lock, not shown, attached to the vehicle trunk lid 2 shown in FIG. 4, as will be more fully described hereinafter. The inner end of first core wire 13*a* is fixedly attached to the outer end of the corresponding positioner motion receiver 13*c*.

The second wire cable 16 arranged substanially in an opposed manner to the first wire cable 13, for unlocking the second lock, not shown, of a gasoline tank cap lid 20, shown in FIG. 4, as will be more fully described hereinafter. The inner end of the second core wire 16*a* is fixedly attached to the outer end 16*d* of the positioner/motion receiver 16*c*.

Enlarged inner ends 13*d;* 16*d* of positioner/motion receivers 13*c;* 16*c* serve for preventing slip-out escapement of respective core wires 13*a;* 16*a* by contact with stop shoulders 14 and 14' formed in the back surface of top wall portion of the container housing 1.

Although not shown, each of repective outer ends of the first and second core wires 13*a;* 16*a* is fitted with automatic return means, preferably return spring, not shown. Thus, once the core wire has been relieved from the drive force coming from the drive motor, thus the core wire being offset from its normal and neutral position with its return spring considerably tensioned, the stored energy will be released through the core wire, and the control slide will be returned to its normal neutral position. All the gearing including pinions 4 and 8 will be thus automatically rotated in the reverse direction towards its initial neutral position, until the combined stopper/positioner 14 reaches to the position shown, thus recovering its contacting relationship with the relating positioning shoulder 14. An opposite positioning shoulder 14' formed in the rear wall surface of top wall part of the housing 1 is also provided and for cooperation with the second core wire 16*a*, and its function will be well understood from the foregoing description of the first core wire 13*a*.

Additionally, 17 and 17' represent a pair of remotely and substantially oppositely provided attaching recesses formed on the container housing 1 adapted for attachment thereof onto the back surface of the trunk lid.

The operation of the inventive vehicle lock actuator is as follows:

When it is required to unlock the trunk lid lock, the operator manipulates the switching slide member at SW to "forward drive-ON" position. Then, current is supplied from the source battery, not shown, to motor 3, thus the latter being driven in its forward drive rotational direction. Thus motion will be transmitted from motor shaft 3*a* through pinion 4, crown gear teeth 5*a*, pinion 5*c* gear teeth 7*a* and pinion 8 to slide 12 which is forcibly translated therefore in righthand direction from its neutral position shown in FIG. 1 and 2.

By this slide's movement, a mechanical pull is applied to first cable end positioner, thus the latter being moved towards right in FIGS. 1 and 2, accompanying the corresponding core wire 13*a*.

By bringing the first core wire to its operating position in the aforementioned way, the trunk lid lock is unlocked.

Figure 3:
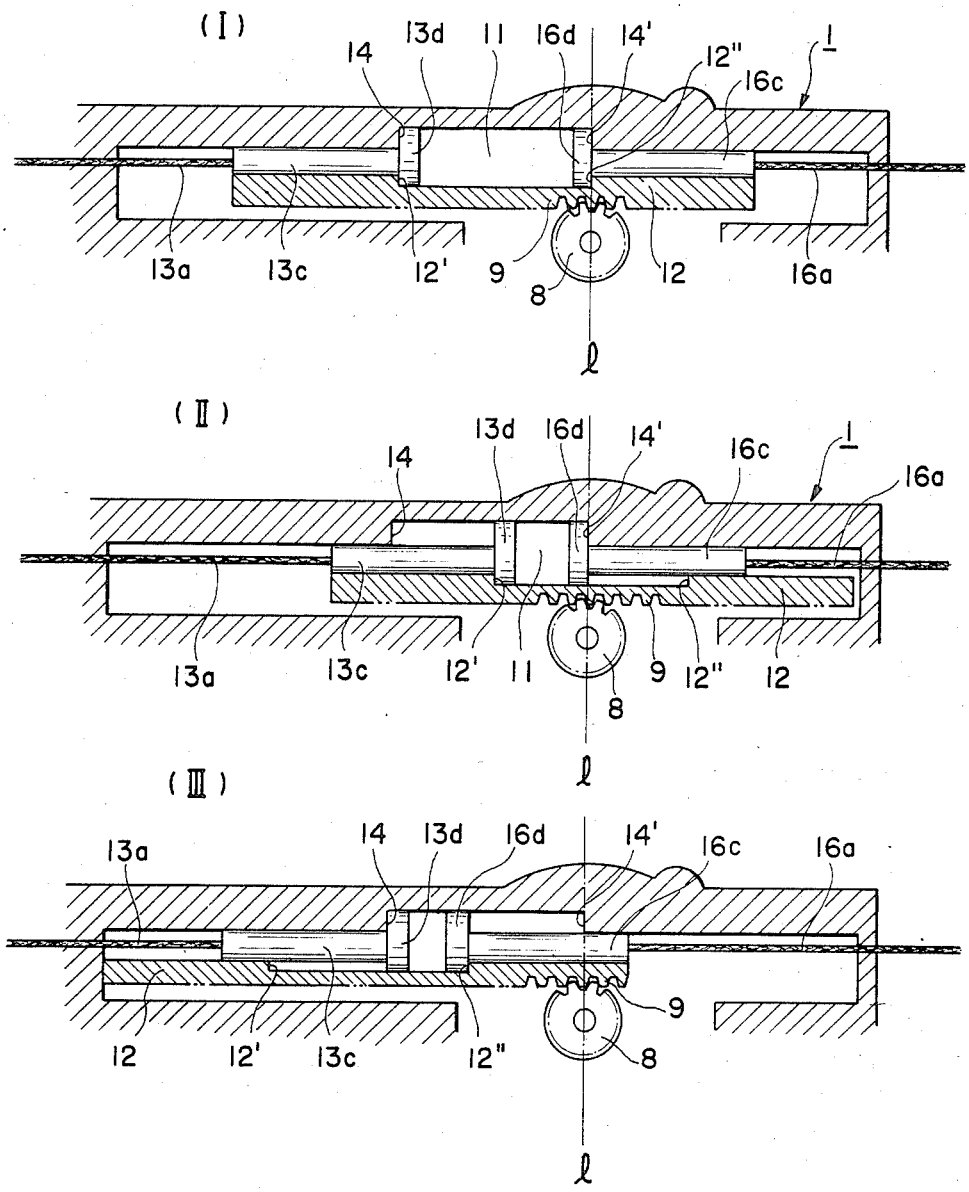
FIG. 3 (I), is part of FIG. 1, showing the operation control slide kept at its neutral position for keeping the two different lid locks in their locked position.

When the switch SW is manipulated to "neutral", the automatic return means will act to move the core wire 13*a* towards to the original position shown in FIGS. 1 and 2, and FIG. 3, (I).

As was referred to hereinbefore, the three stage reduction gearing will act now as an accelerator. Motion will be transmitted automatically from the slide to the motor. Thus, the rotor of the latter will be caused to rotate in the reverse direction. Finally, the rotor will be reversely rotated until it reaches the initial neutral position.

When the switch SW is manipulated to "reverse", the drive motor will be rotated in the reverse direction and the second core wire 16*a* will be inwardly offset position for unlocking the vehicle fuel reservoir lid lock, and so on.

Although the foregoing description has been set forth on the two vehicle locks, it should be noted that the present inventive lock actuator can be applied in various technical fields other than vehicle locks for control of remotely positioned two lock in successive order.

It should be further mentioned that small character er "1" appearing in FIG. 3 represents the center line of the control slide when it is positioned at its neutral position where the both vehicle locks are kept in their locking position.

What is claimed is:

1. Lock actuator comprising:

a container housing;

a drive motor of reversible type and mounted in the container housing;

a remote ontrol switching unit for operation control of the said drive motor;

an operation control slide mounted in the container housing and translatable in a reciprocatable manner;

a first operation-transmitting wire cable leading from said slide to one of a pair of locks;

a second operation-transmitting wire cable leading from said slide to another of said pair of locks;

inner, motion-receiving enlarged heads of each of said operation-transmitting wire cables being arranged such that said enlarged heads face one another;

an at least two stage, reversible reduction gearing arranged between said drive motor and said operation control slide, the latter having three operating positions, one of which is offset relative to a neutral position for pullingly actuating the first wire cable; a second one of which is said neutral position and a third one of which is offset oppositely from said one position for pullingly actuating the second wire cable.

2. Lock actuation of claim 1, wherein said drive motor is an electric motor.

3. Lock actuator of claim 1, wherein said at least two stage reduction gearing is a three stage gearing which comprises crown gear teeth at its first stage and where in rack teeth are provided at its final stage, and further wherein the rack teeth are made integral with said operation control slide.

4. Lock actuator of claim 2, wherein said switching unit is a slide switch having three operating positions for putting said drive motor into forward drive, turning said drive motor off and putting said drive motor into reverse drive.

5. Lock actuator of claim 1, wherein said remote control switching unit is mounted in close proximity of a driver's seat of an automotive vehicle.

* * * * *